US006189271B1

(12) United States Patent
Christensen

(10) Patent No.: US 6,189,271 B1
(45) Date of Patent: Feb. 20, 2001

(54) BUILDING SYSTEMS

(76) Inventor: Daniel L. Christensen, 1635 Cedar Lake Pkwy., Minneapolis, MN (US) 55416

( * ) Notice: Under 35 U.S.C. 154(b), the term of this patent shall be extended for 0 days.

(21) Appl. No.: 09/207,117

(22) Filed: Dec. 7, 1998

Related U.S. Application Data

(63) Continuation-in-part of application No. 29/034,646, filed on Feb. 9, 1995, now Pat. No. Des. 402,229.

(51) Int. Cl.[7] ..... E04B 1/02
(52) U.S. Cl. ..... 52/233; 52/747.1; 446/106
(58) Field of Search ..... 52/233, 747.1; 446/106

(56) References Cited

U.S. PATENT DOCUMENTS 1,402,438 * 1/1922 Nichols ..... 52/233 X
1,574,191 * 2/1926 Groves ..... 446/106 X
2,059,598 * 11/1936 Paulson ..... 446/106
2,712,678 * 7/1955 Jensen ..... 52/233
2,946,150 * 7/1960 Houk ..... 52/233 X
3,381,428 * 5/1968 Sillman ..... 52/233
3,440,784 * 4/1969 Onjukka ..... 52/233
3,676,969 * 7/1972 Moore ..... 52/233
4,356,676 * 11/1982 Hauptman ..... 52/233 X
4,823,528 * 4/1989 Faw ..... 52/233
4,901,489 * 2/1990 Garber ..... 52/233

* cited by examiner

*Primary Examiner*—Carl D. Friedman
*Assistant Examiner*—Kevin D. Wilkens
(74) *Attorney, Agent, or Firm*—Burd, Bartz & Gutenkauf

(57) ABSTRACT

A building system which uses a plurality of interlocking members which can be used to construct an unlimited number of structures which can be assembled, disassembled and used by children and adults. The building system requires no tools, fasteners or adhesives, yet creates rigid and sturdy structures of all sizes, through interlocking ends and edges.

17 Claims, 9 Drawing Sheets

BUILDING SYSTEMS

CROSS REFERENCES TO CO-PENDING APPLICATION

This patent application is a continuation-in-part of Ser. No. 29/034,646 entitled "KNOCK-DOWN PLANTER" filed on Feb. 9, 1995, now U.S. Pat. No. Des. 402,229 by the same inventor.

BACKGROUND OF THE INVENTION

1. Field of the Invention

The present invention is in the field of building systems, and more particularly, pertains to a plurality of interconnecting members which secure in a rigid and stable manner without the use of fasteners, adhesives, or the like, which are easily assembled and disassembled without the need for tools. Building system members can be made in any number of sizes and scales allowing building systems to create life size playhouses, utility sheds, bins and various other toy and play scale structures. The building systems are designed to be safely and easily used by adults and children alike.

SUMMARY OF THE INVENTION

The general purpose of the present invention are building systems which do not require the use of fasteners, adhesives, or tools.

According to one embodiment of the present invention, there is provided a plurality of intermediate members, having upper and lower beveled portions, four notches, a tongue joint, a groove joint, larger inbound shoulders and smaller outbound shoulders. There are also provided upper and lower members which are constructed using the same principles as the intermediate portions with many like features.

One significant aspect and feature of the present invention are the various means of interlocking member ends in ways that create rigid and sturdy structures.

Another significant aspect and feature of the present invention are the various means of interlocking member edges for added stability.

A further significant aspect and feature of the present invention is smaller outbound shoulders than inbound shoulder which prevents damage during assembly and disassembly.

An additional significant aspect and feature of the present invention are the unlimited structure configurations using the building systems.

Still another significant aspect and feature of the present invention is the ability to use wood, plastic or metal in construction.

Yet another significant aspect and feature of the present invention are building systems which requires no tools for assembling. Components are reuseable to create other structures.

Having thus described embodiments of the present invention, it is the principal object of the present invention to provide a building system which requires no fasteners or adhesives for securation.

One object of the present invention is to provide a building system which is easy to assembly by adults and children.

Another object of the present invention is to provide a portable building system.

A further object of the present invention is to provide a building system which requires no tools for construction.

An additional object of the present invention is to provide building systems which are easy to breakdown, transport, and store. Compact storage for components that can build relatively large and stable structures.

Still another object of the present invention is to provide building systems which create useful structures such as, but not limited to retail displays, playhouses, shipping boxes, and camping cabins. User-friendly, intuitive, as easy as play for a child.

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein:

DETAILED DESCRIPTION OF THE PREFERRED EMBODIMENTS

Figure 1:
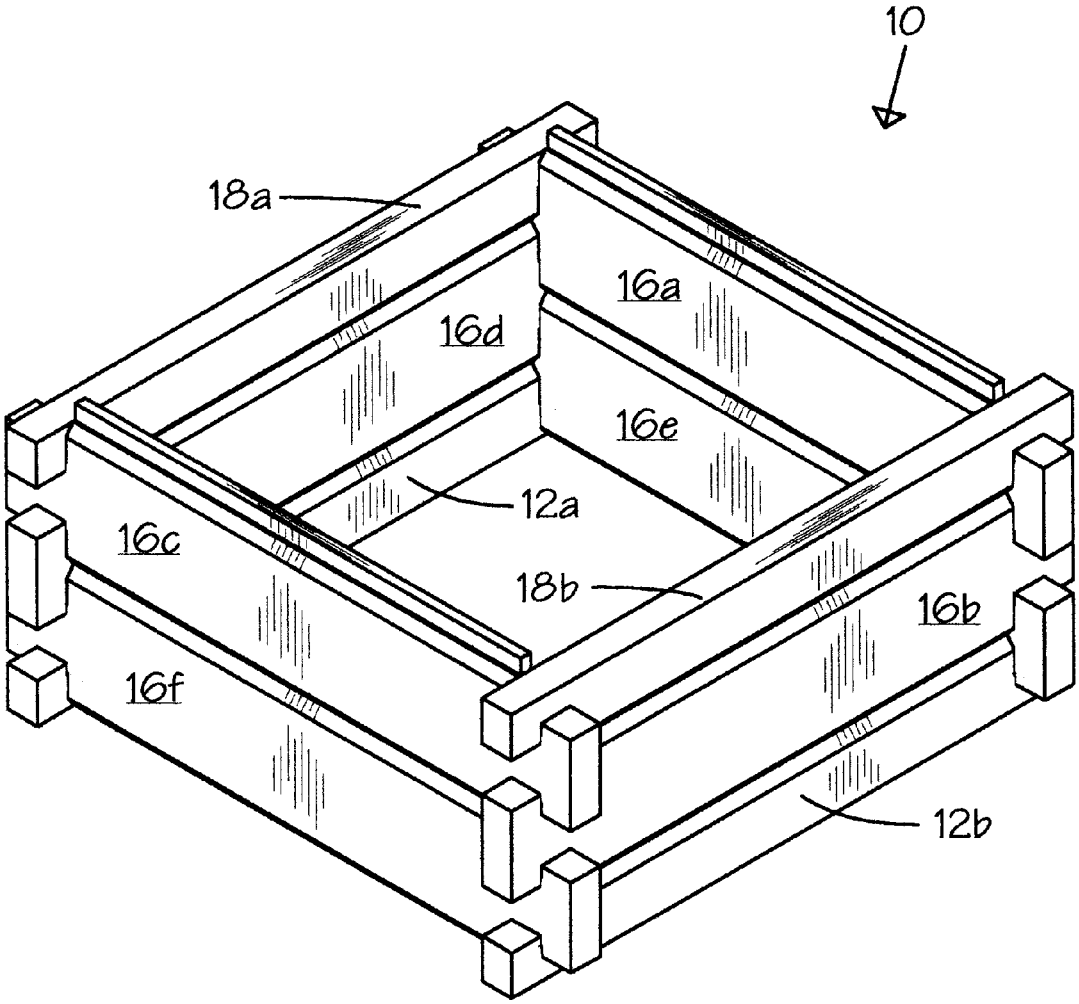
FIG. 1 illustrates an orthographic view of a building system, the present invention.

FIG. 1 illustrates an orthographic view of a building system 10 having lower members 12*a* and 12*b*, intermediate members 16*a*, 16*b*, 16*c*, 16*d*, 16*e* and 16*f*, and upper members 18*a* and 18*b*, interlocked together via a combination of tongue and groove edge joints and notch end joints. The tongue and groove joints lock the top and bottom edges together and the notch joints lock the corners together. These joints are further described in FIG. 2.

Figure 2:
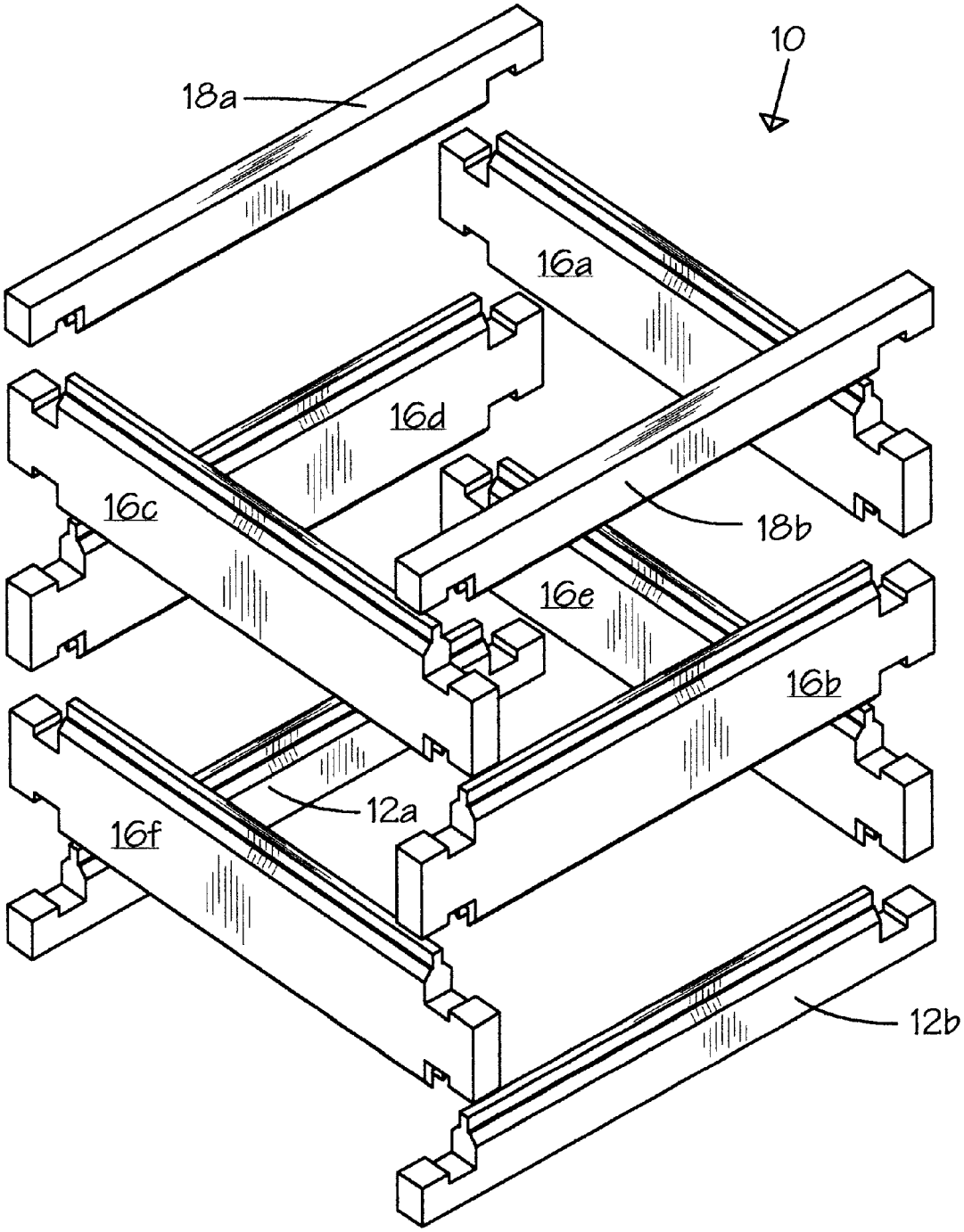
FIG. 2 illustrates an exploded orthographic view of the building system of FIG. 1.

FIG. 2 illustrates an exploded orthographic view of the building system 10, where all numerals correspond to those elements previously described. Featured in this illustration is the assembly method of the Building system 10 having two lower half height members 12*a* and 12*b,* a plurality of intermediate full height members 16*a*–16*f,* and two upper half height members 18*a* and 18*b*. FIG. 2 illustrates only six intermediate members 16*a*–16*f,* but an unlimited number of intermediate members may be used to acquire the desired height. FIGS. 3–8 describe the properties of the components of the building system 10.

Figure 3:
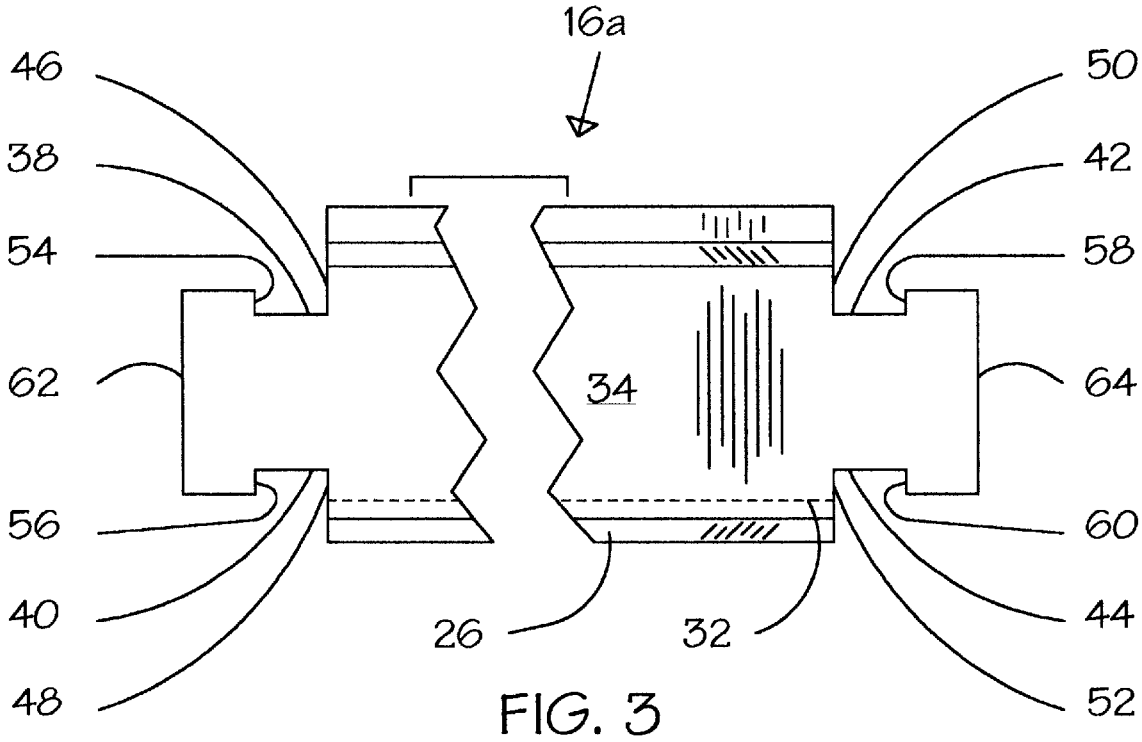
FIG. 3 is an enlarged fragmentary elevational front view of a full height intermediate member of the building system of FIG. 1.
Figure 4:
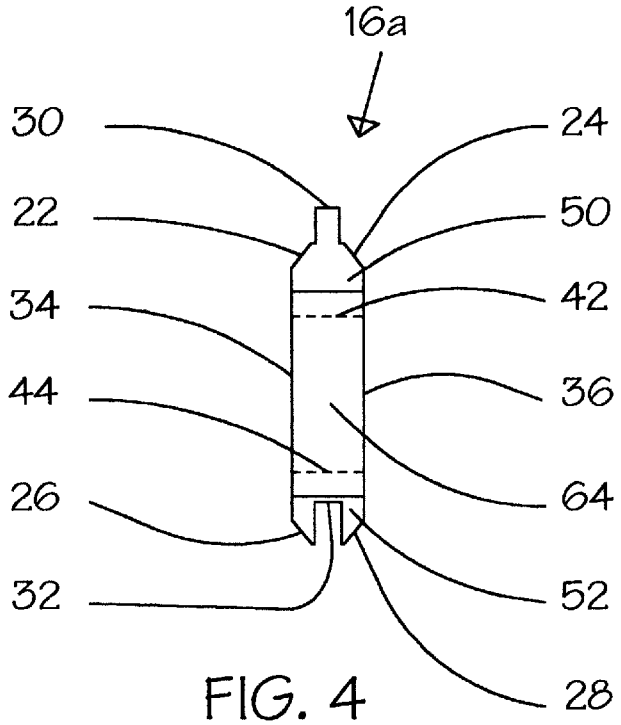
FIG. 4 illustrates an end elevational view of the full height intermediate member of FIG. 3.

FIG. 3 illustrates a front view of the intermediate full height member 16*a,* and FIG. 4 illustrates an end view of the intermediate full height members 16*a*–16*f.* With additional reference to FIG. 1 and FIG. 2, the features of intermediate member 16*a* is now described. Member 16*b,* 16*c,* 16*d,* 16*e,* and 16*f* are identical to member 16*a*. Intermediate member 16*a* has two upper beveled portions 22 and 24 which extend upwardly and inwardly from planar portions 34 and 36 and meet at a tongue joint 30. Also featured are lower beveled portions 26 and 28 which extend downwardly and inwardly from planar portions 34 and 36 and meet at a groove joint 32. The combination of the tongue joint 30 and the groove joint 32 combine to create an interlocking means for the upper and lower surfaces of adjacent intermediate members. Notches 38, 40, 42, and 44 create inbound shoulders 46, 48, 50, and 52, outbound shoulders 54, 56, 58 and T-shaped end portions 62 and 64. The outbound shoulders 54–60 are smaller than inbound shoulders 46, 48, 50, and 52 to facilitate easy interconnection and prevent the end portions 62 and 64 from damage when connecting and disconnecting the building system 10, without sacrificing the strength and rigidity of the building system 10.

Figure 5:
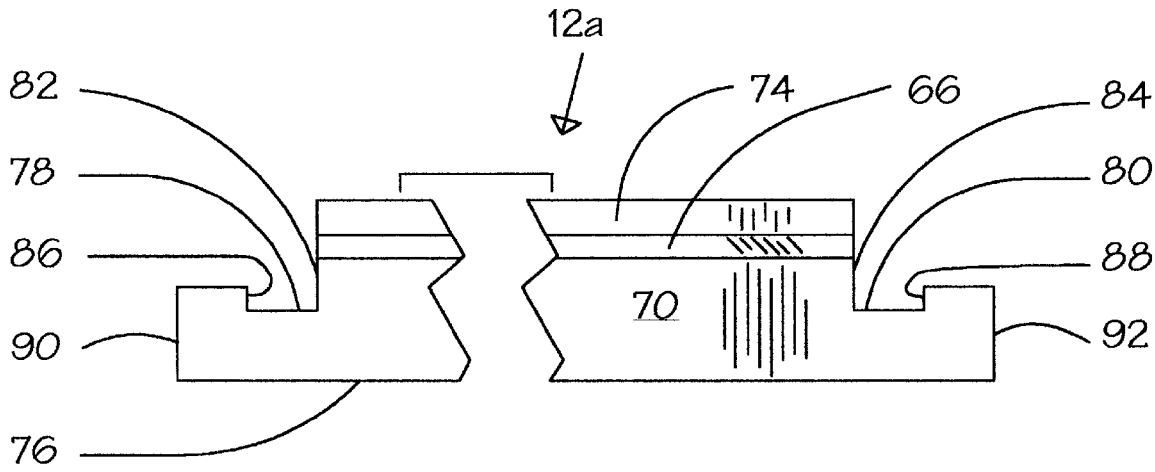
FIG. 5 is an enlarged fragmentary front elevational view of a half height lower member of the building system of FIG. 1.
Figure 6:
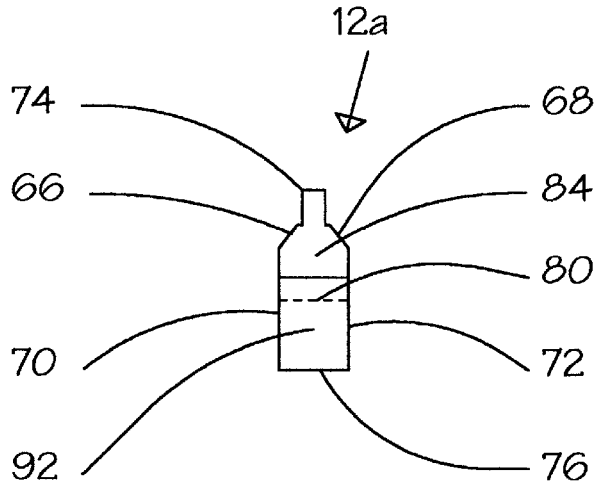
FIG. 6 illustrates an end elevational view of the half height lower member of FIG. 5.

FIG. 5 illustrates a front view of lower half height member 12*a,* and FIG. 6 illustrates an end view of the lower half height member 12*a*. With additional reference to FIG. 1 and FIG. 2, the features of lower member 12*a* are now described. Lower member 12*b*has the same structure as lower member 12*a*. Lower member 12*a* is comprised of two upper beveled portions 66 and 68 which extend upwardly and inwardly from planar portions 70 and 72 and meet at a tongue joint 74. Tongue joint 74 allows lower half height member 12*a* to interlock with the groove joints 32 of the intermediate members 16*d* and 16*b*. Also featured is a lower planar portion 76 which perpendicularly meets planar portions 70 and 72 as shown in FIG. 6., which creates a flat stable base for the building system 10. Notches 78 and 80 create inbound shoulders 82 and 84, outbound shoulders 86 and 88, and end portions 90 and 92.

Figure 7:
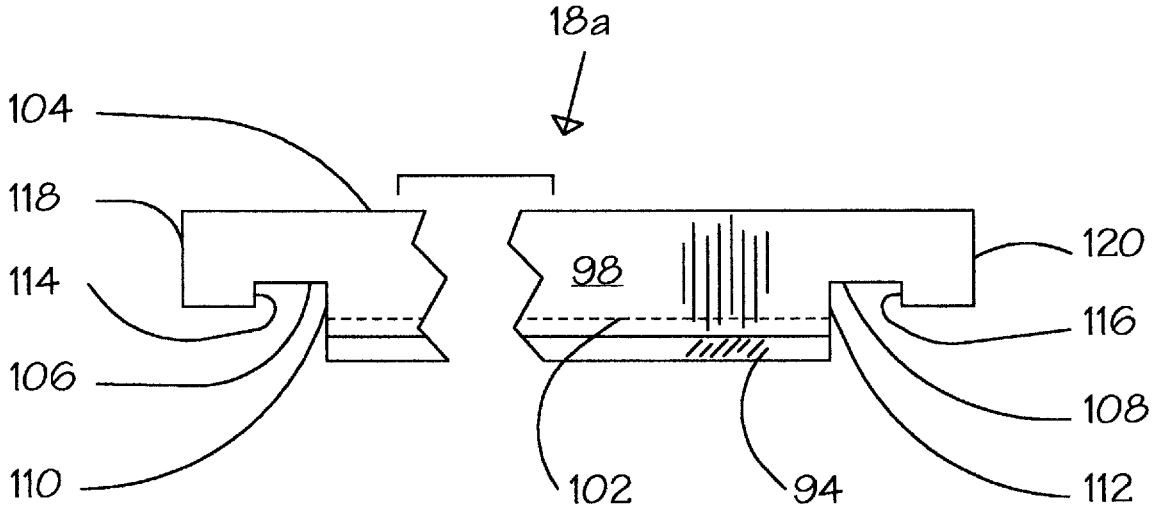
FIG. 7 is an enlarged fragmentary front elevational view of a half height upper member of the building system of FIG. 1.
Figure 8:
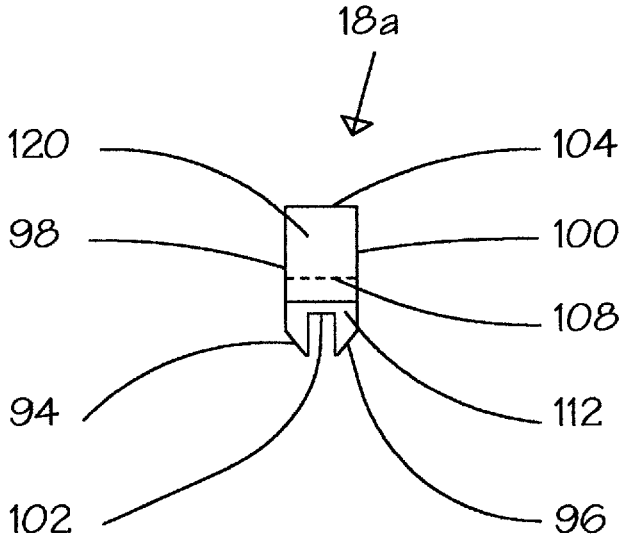
FIG. 8 illustrates an end elevational view of the half height upper member of FIG. 7.

FIG. 7 illustrates a front view of upper half height member 18*a,* and FIG. 8 illustrates an end view of the lower half height member 18*a*. With additional reference to FIG. 1 and FIG. 2, the features of upper member 18*a* are now described. Upper half height member 18*b* has the same structure as lower half height member 18*a*. Upper member 18*a* are comprised of two lower beveled portions 94 and 96 which extend downwardly and inwardly from planar portions 98 and 100 and meet at a groove joint 102. Groove joint 102 allows upper member 18*a* to interlock with the tongue joint 30 of the intermediate members 16*d* and 16*b*. Also featured is the upper planar portion 104 which perpendicularly meets planar portions 98 and 100 as shown in FIG. 8., which creates a flat, smooth top for the building system 10. Notches 106 and 108 create inbound shoulders 110 and 112, outbound shoulders 114 and 116, and end portions 118 and 120. The notches 106 and 108 in upper member 18*a* perpendicularly engage the notches 38 and 42 of intermediate portions 16*d* and 16*b,* creating a rigid and stable interconnection.

Figure 9:
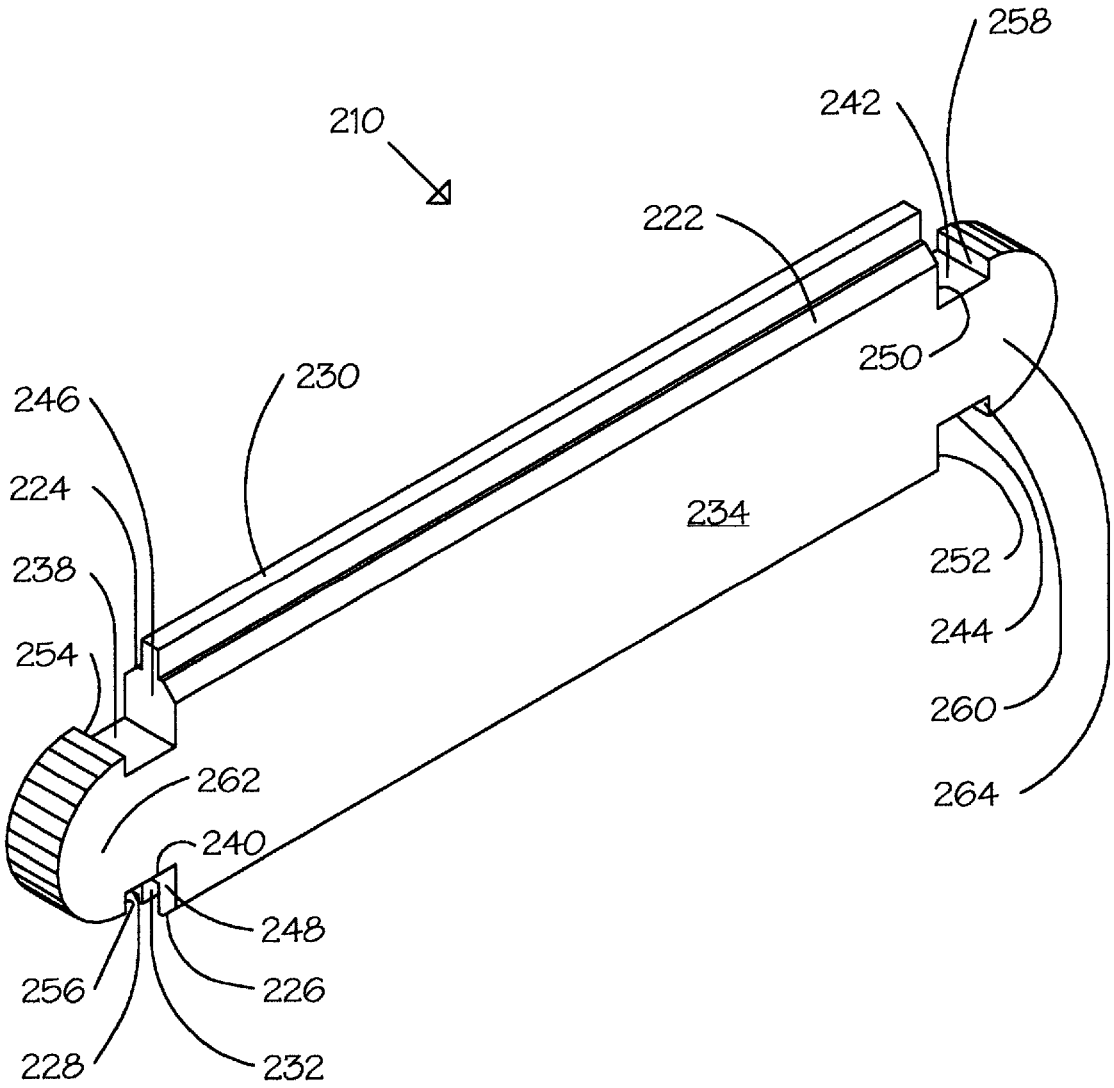
FIG. 9 illustrates an orthographic view of a first modification of a stylized, notched, full height, intermediate member of the building system of FIG. 1.

FIG. 9 illustrates an orthographic view of a stylized intermediate member 210, which is a first modification of member 16*a*. The parts of member 210 that correspond to the parts of member 16*a* have the same reference numbers with the prefix 2. The stylized intermediate member 210 is comprised of two upper beveled portions 222 and 224 which extend upwardly and inwardly from planar portions 234 and 236 and meet at a tongue joint 230. Also featured are lower beveled portions 226 and 228 which extend downwardly and inwardly from planar portions 234 and 236 and meet at a groove joint 232. Notches 238, 240, 242, and 244 create inbound shoulders 246, 248, 250, and 252 outbound shoulders 254, 256, 258 and 260, and stylized end portions 262 and 264. The stylized end portions 262 and 264 are illustrated as rounded, but may be any number of shapes provided the outbound shoulders 254, 256, 258 and 260 remain the same height. The stylized end portions 262 and 264 serve no functional purpose, but are shaped differently than the intermediate members of the preferred embodiment for aesthetic purposes only. The stylized intermediate member 210 can be substituted for any or all of the intermediate members 16*a*–16*f* in FIGS. 1 and 2.

Figure 10:
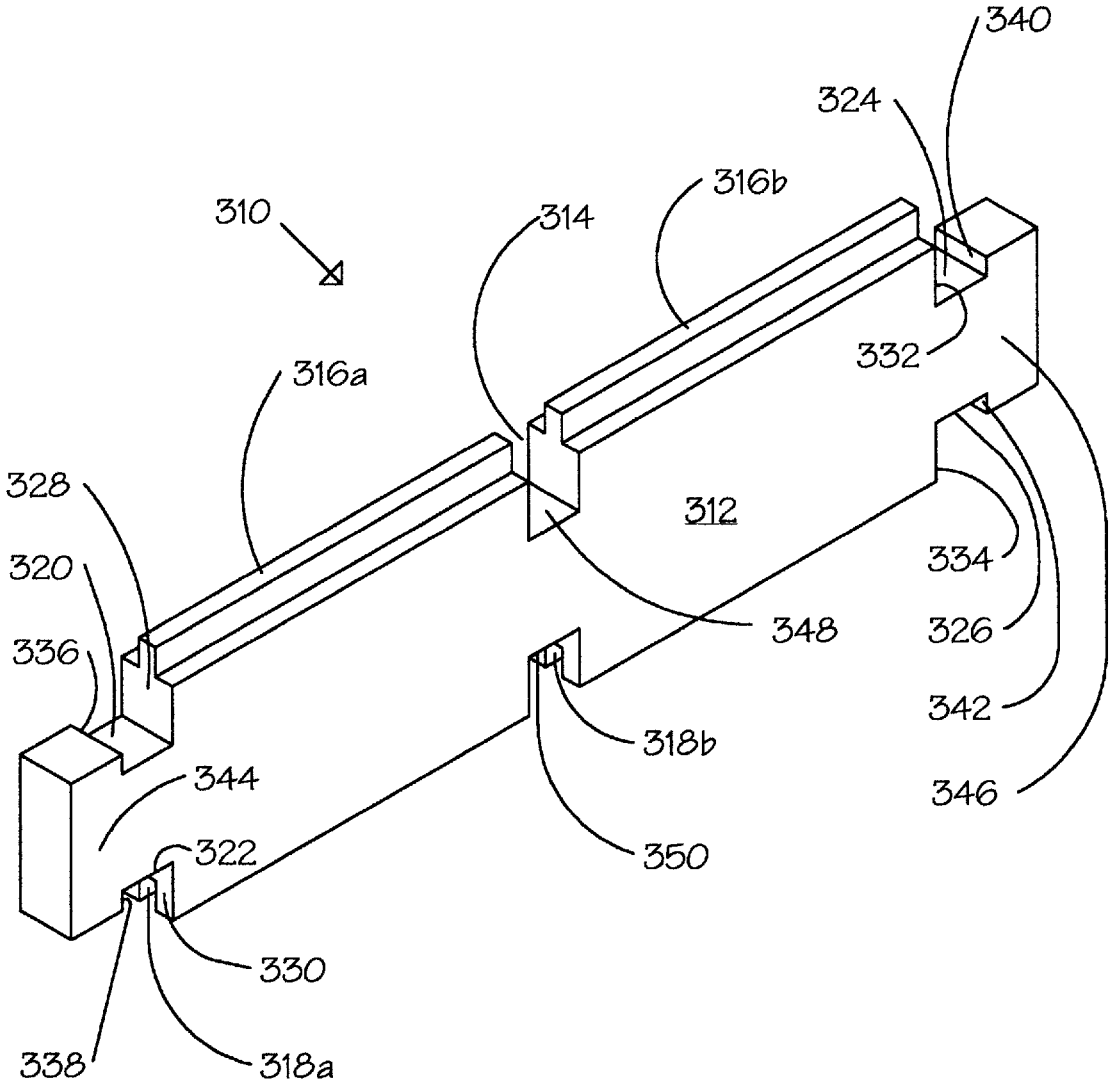
FIG. 10 illustrates an orthographic view of a second modification of a notched intermediate member of the building system of FIG. 1.

FIG. 10 illustrates an orthographic view of a notched intermediate member 310, which is a second modification of member 16*a*. The parts of member 310 that correspond to the parts of member 16*a* have the same reference numbers with the prefix 3. Notched intermediate member 310 incorporates two tongue joints 316*a* and 316*b* extending upwardly from planar portions 312 and 314 and two groove joints 318*a* and 318*b* extending downwardly from planar portions 312 and 314. The tongue joints 316*a* and 316*b* and the groove joints 318*a* and 318*b* function in the same manner as tongue joint 30 and groove joint 32 described in the preferred embodiment. Notched intermediate member 310 incorporates notches 320, 322, 324, and 326, inbound shoulders 328, 330, 332, and 334, outbound shoulders 336, 338, 340, and 342 and end portions 344 and 346 which are constructed and function in the same manner as the like parts of the preferred embodiment. With reference to FIG. 1 and FIG. 2, there is also provided an upper intermediate notch 348 and a lower intermediate notch 350 which accommodate the notches 38, 40, 42, and 44 of intermediate member 16*a* or the like intermediate members 16*b*–16*f,* which are all similarly constructed. By using a plurality of notched intermediate members, similar to notched intermediate member 310, the upper and lower intermediate notches 348 and 350, respectively, provide the ability to expand the configuration possibilities of the building system 10.

Figure 11:
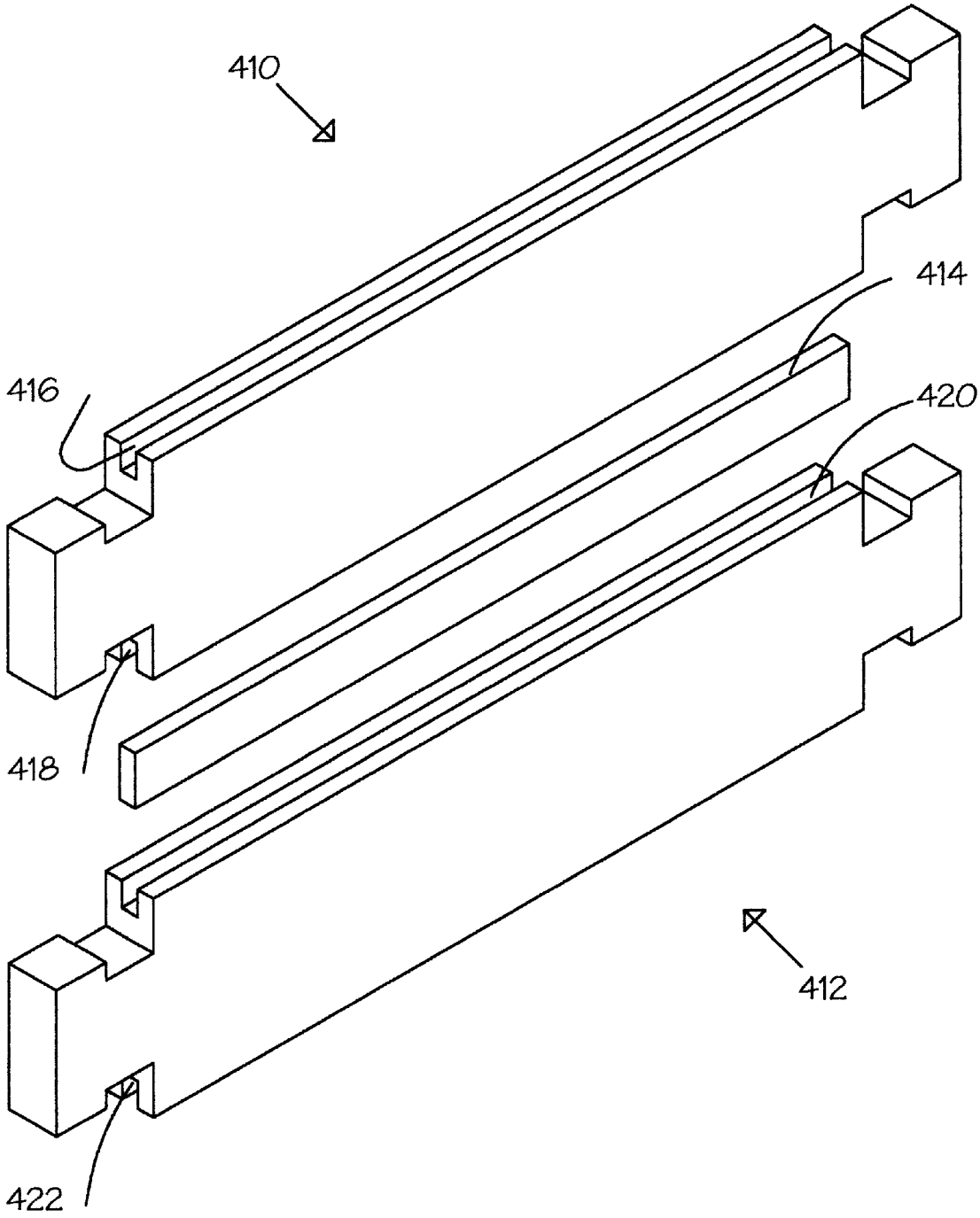
FIG. 11 illustrates an exploded orthographic view of a third modification of two full height intermediate members and a spline for connecting the intermediate members of the building system of FIG. 1.

FIG. 11 illustrates an exploded orthographic view of two intermediate members 410 and 412 and a spline 414 for connecting the two intermediate members 410 and 412, which is a third modification of member 16*a*. Each of the intermediate members 410 and 412 incorporate upper groove joints 416 and 420, respectively, and lower groove joints 418 and 422, respectively, which accommodate splines for interconnection by gravitational engagement. Illustrated is spline 414, which engages lower groove joint of intermediate member 410 and upper groove joint of intermediate member 412. The intermediate members 410 and 412 in conjunction with spline 414 act as an alternative to the incorporated tongue and groove joints of intermediate members 16*a*–16*f* illustrated in the preferred embodiment. With exception to the upper groove joints 416 and 420 in intermediate members 410 and 412 and the spline 414 the intermediate members 410 and 412 have the same properties and features as the intermediate members 16*a*–16*f* and function in a similar fashion. The like parts illustrated are not described or numbered for purposes of clarity, but function in the same capacity as those previously described.

Figure 12:
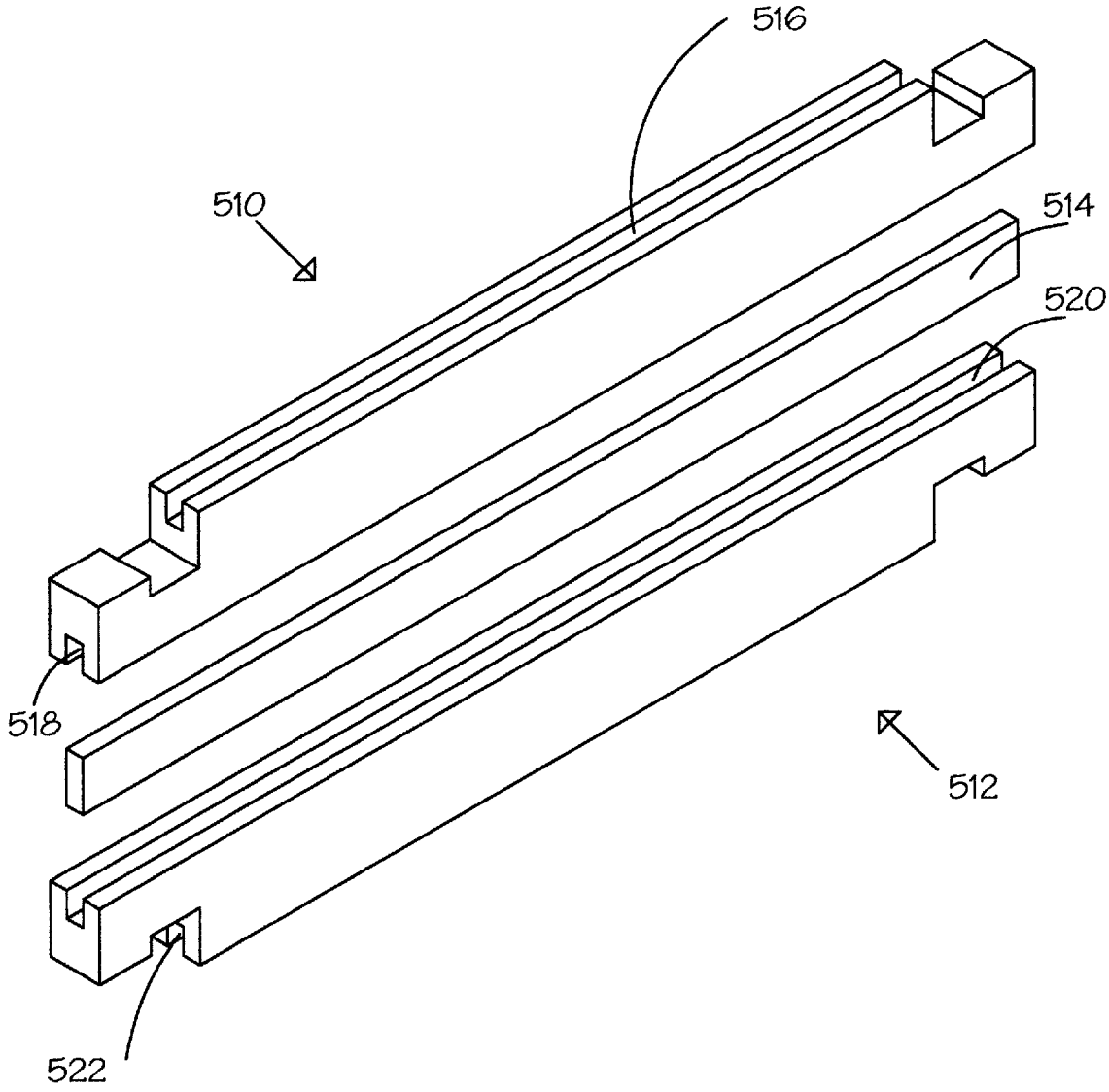
FIG. 12 illustrates an exploded orthographic view of a fourth modification of an upper half height member, a lower half height member and a spline for connecting the upper and lower members of the building system of FIG. 1.

FIG. 12 illustrates an exploded orthographic view of an upper half height member, a lower half height member and a spline for connecting the upper and lower members, which is a fourth modification of member 16*a*. With reference to FIG. 1, FIG. 2 and FIGS. 5–8, the upper member 510 is constructed similar to lower members 12*a* and 12*b* and lower member 512 is constructed similar to upper members 18*a* and 18*b*. The difference between the lower members 12*a* and 12*b* and the upper members 18*a* and 18*b* and the upper member 510 and the lower member 512 is that the upper member 510 incorporates an upper groove joint 516 and a lower groove joint 518, and the lower member 512 also incorporates an upper groove joint 520 and a lower groove joint 522 which when used in conjunction with a splines eliminates the tongue joints of the preferred embodiment. The lower groove joint 518 of the upper member 510 and the upper groove joint 520 of the lower member 512 accommodate spline 514. When interconnected, the upper member 510, the spline 514 and the lower member 512 function in the same manner as intermediate members 410 and 412 of FIG. 11. The like parts illustrated are not described or numbered for purposes of clarity, but function in the same capacity as those previously described.

Various modifications can be made to the present invention without departing from the apparent scope hereof.

I claim:

1. A structure having a plurality of interlocked members comprising:

a first member having planar opposite sides, a top portion having a continuous linear tongue, a generally flat bottom surface, a first end, and a second end, a first upwardly open notch in the first end, and a second upwardly open notch in the second end, the portion of the first member between the first and second ends has a vertical dimension greater than the vertical dimension of each of the first and second ends, a second member having at least a pair of vertically aligned notches, said first notch of the first member being located in one notch of the second member, and a third member having at least one notch and a groove, said one notch of the third member being located in the other notch of the second member and the tongue of the first member being located in the groove of the third member.

2. The structure of claim 1 wherein: said first and second ends have bottom surfaces coextensive with the bottom surface of the member.

3. The structure of claim 1 wherein: the second member has a first part having opposite ends with upwardly open notches and a bottom portion with a linear groove, a second part having opposite ends with downwardly open notches and a top portion with a linear groove, and a flat elongated spline located in said grooves to connect the first and second parts.

4. The structure of claim 1 wherein: the third member has planar opposite sides, a bottom portion having a longitudinal downwardly open groove and first and second ends, each of said ends having a downwardly open notch, one of said downwardly open notches being located in the other notch of the second member.

5. A structure having a plurality of interlocked members comprising:

a first member having at least one upwardly open notch and a tongue, a second member having at least a pair of vertically aligned notches, said one notch of the first member being located in one notch of the second member and a third member having at least one downwardly open notch and a groove, said one notch of the third member being located in the other notch of the second member and the tongue of the first member being located in the groove of the third member, the second member has planar opposite sides, a top portion having a continuous linear tongue, a bottom portion having a continuous linear groove, a first end and second end, upwardly and downwardly open notches in the first end, and upwardly and downwardly open notches in the second end, one of said downwardly open notches being located in the one upwardly open notch of the first member and one of the upwardly open notches being located in the one downwardly open notch of the third member, and the portion of the second member between the first and second ends has a vertical dimension greater than the vertical dimension of each end.

6. The structure of claim 5 wherein: the first member has a flat bottom surface.

7. A structure having a plurality of interlocked members comprising:

a first member having at least one notch and a tongue, a second member having first and second ends and at least a pair of vertically aligned notches in said ends, the first and second ends of the second member each have a semi-cylindrical outer surface, said one notch of the first member being located in one notch of the second member and a third member having at least one notch and a groove, said one notch of the third member being located in the other notch of the second member and the tongue of the first member being located in the groove of the third member.

8. The structure of claim 7 wherein: the portion of the second member between the first and second ends has a vertical dimension greater than the major vertical dimension of each of the first and second ends.

9. A structure having a plurality of interlocked members comprising:

a first member having planar opposite sides, a top portion, a generally flat bottom surface, a first end, and a second end, a first upwardly open notch in the first end, and a second upwardly open notch in the second end, the portion of the first member between the first and second ends has a vertical dimension greater than the vertical dimension of each of the first and second ends, a second member having opposite ends and at least a pair of vertically aligned notches, the portion of the second member between the opposite ends of the second member has a vertical dimension greater than the vertical dimension of each of the opposite ends of the second member, said first notch of the first member being located in one notch of the second member, and a third member having at least one notch and opposite ends, said first and third members having a cooperating tongue and groove between opposite ends thereof, said one notch of the third member being located in the other notch of the second member and said cooperating tongue and groove of the first and third member being interlocked.

10. The structure of claim 9 wherein: the portion of the third member between the opposite ends of the third member has a vertical dimension greater than the vertical dimension of each of the opposite ends of the third member.

11. A method of making a structure comprising:

providing a first member having a first end and a second end opposite the first end, one of said ends having only an upwardly open notch, a top portion extended between said ends, a tongue on said top portion, and the portion of the first member between the first and second ends has a vertical dimension greater than the vertical dimension of each of the first and second ends;

providing a second member having a first end and a second end, one of said ends of the second member having upwardly and downwardly vertically aligned notches, the portion of the second member between the first and second ends thereof has a vertical dimension greater than the vertical dimension of each of the first and second ends of the second member, providing a third member having a first end and a second end, one of said ends having a downwardly open notch, and a bottom portion with a groove, the portion of the third member between the first and second ends thereof has a vertical dimension greater than the vertical dimension of each of the first and second ends of the third member, locating the ends of the first, second and third members with the notches adjacent each other, interlocking the adjacent ends of the first and second members by placing the upwardly open notch of the first member in the downwardly open notch of the second member to releasably connect the first and second members; and interlocking the adjacent ends of the second and third members by placing the downwardly open notch of the third member into the upwardly open notch of the second member and inserting the tongue of the first member into the groove of the third member to releasably connect the first, second and third members.

12. The method of claim 11 wherein: the first member has upwardly open notches in the first and second ends thereof, said third member has downwardly extended notches in the first and second ends thereof, and providing a fourth member having an end with upwardly and downwardly vertically aligned notches, locating the end of the fourth member adjacent the ends of the first and third members opposite the second member, and interlocking the fourth member to the first and third members by placing one of the upwardly open notches of the first member into the downwardly open notch of the fourth member and placing one of the downwardly open notches of the third member into the upwardly open notch of the fourth member.

13. The method of claim 11 including: providing a fourth member having an end with a downwardly open notch and a bottom portion having a groove, said third member having an upwardly open notch, and said second member having a top portion with a tongue, and interlocking said fourth member with said second and third members by placing the downwardly open notch of the fourth member into the upwardly open notch of the third member and inserting the tongue of the second member into the groove of the fourth member.

14. The method of claim 13 including: providing a fifth member having an end with a downwardly open notch and a bottom portion with a groove, said third member having a top portion with a tongue, said fourth member having an upwardly open notch aligned with the downwardly open notch therein, and interlocking said fifth member with said fourth and third members by placing the downwardly open notch of the fifth member into the upwardly open notch of the fourth member and inserting the tongue of the third member into the groove of the fifth member.

15. A method of making structure comprising:

providing a pair of linear first members having opposite ends with only upwardly open notches, top portions with linear tongues extended between said ends, and the portions of the first members between the opposite ends have vertical dimensions greater than the vertical dimensions of each of the opposite ends;

providing a first pair of second members having opposite ends with upwardly and downwardly open notches, top portions with linear tongues, and the portions of the second members between the opposite ends of the second members have vertical dimensions greater than the vertical dimensions of each of the opposite ends of the second members;

providing a pair of third members having opposite ends with downwardly open notches, bottom portions with linear grooves, and the portions of the third members between the opposite ends of the third members have vertical dimensions greater than the vertical dimensions of each of the opposite ends of the third members;

positioning the pair of the second members between the opposite ends of the first members, interlocking adjacent ends of the pair of first members and the pair of second members by placing adjacent ends in adjacent notches in the pair of first members and the pair of second members to releasably connect the first and second pairs of members;

positioning the third pair of members between opposite ends of the pair of second members, and interlocking the third pair of members with the pair of second members and pair of first members by inserting the tongues of the first members in the grooves of the third members and placing adjacent ends of the second and third members in adjacent notches in the second and third members to releasably connect the first, second and third pair of members.

16. The method of claim 15 including: locating the first and third pairs of members parallel and vertically aligned with each other.

17. The method of claim 15 including:

providing additional pairs of second members having opposite ends with upwardly and downwardly open notches, top portions with linear tongues, and bottom portions with linear grooves.

* * * * *